US006888058B2

(12) United States Patent
Urai et al.

(10) Patent No.: US 6,888,058 B2
(45) Date of Patent: May 3, 2005

(54) ELECTRONIC MUSICAL INSTRUMENT

(75) Inventors: Tomomitsu Urai, Hamamatsu (JP); Shinichi Sawara, Kosai (JP); Fukushi Kawakami, Hamakita (JP)

(73) Assignee: Yamaha Corporation (JP)

( * ) Notice: Subject to any disclaimer, the term of this patent is extended or adjusted under 35 U.S.C. 154(b) by 182 days.

(21) Appl. No.: 10/340,417

(22) Filed: Jan. 10, 2003

(65) Prior Publication Data

US 2003/0126975 A1 Jul. 10, 2003

(30) Foreign Application Priority Data

Jan. 10, 2002 (JP) ..... 2002-003011

(51) Int. Cl.[7] ..... G10H 1/02
(52) U.S. Cl. ..... 84/737; 318/63; 318/118
(58) Field of Search ..... 84/718, 737; 318/118, 318/59, 61, 63, 103

(56) References Cited

U.S. PATENT DOCUMENTS 3,506,773 A * 4/1970 George ..... 84/699
6,157,724 A * 12/2000 Kawakami ..... 381/63
6,696,633 B2 * 2/2004 Miyagishima et al. ..... 84/737

FOREIGN PATENT DOCUMENTS

JP 5-88674 A 4/1993
JP 10-247089 A 9/1998

* cited by examiner

*Primary Examiner*—Jeffrey W Donels
(74) *Attorney, Agent, or Firm*—Rossi, Kimms & McDowell, LLP

(57) ABSTRACT

Main speakers are arranged on the enclosure front surface of an electronic piano. Auxiliary speakers (18L, 18R) are arranged on the rear surface of the enclosure. Microphones are arranged in close proximity of the main speakers. A performance sound is regenerated from the main speakers. The regenerated sound from the main speakers is picked up by microphones (20L, 20R). FIR filters are used to generate the reflected signal of a picked-up sound signal from the microphones. The generated reflected sound signal is regenerated from auxiliary speakers.

19 Claims, 10 Drawing Sheets

ELECTRONIC MUSICAL INSTRUMENT

BACKGROUND OF THE INVENTION

The present invention relates to an electronic musical instrument, such as an electronic keyboard instrument, having an acoustic feedback system of a new configuration.

The regeneration system of a related art electronic musical instrument generally uses 2-channel speaker units arranged right and left to regenerate a performance sound. Some of the related art electronic musical instruments regenerate a musical sound with reverberation added. Related art electronic musical instruments using an acoustic feedback system to pick up a performance sound on a microphone and regenerate the performance sound with a reflected sound added is described in the Japanese Patent Unexamined Publication No. 88674/1994 and the Japanese Patent Unexamined Publication No. 247089/1998.

According to the related art electronic musical instruments, the depth and profundity of a musical sound similar to those of a natural musical instrument have not been obtained. The electronic musical instrument which regenerates a performance sound with reverberation added provides the expanse of a sound but not the depth and profundity of a musical sound. The related art electronic musical instrument using an acoustic feedback system provides the echo of a sound field but same speaker units are used to regenerate the performance sound and to regenerate a microphone-picked-up sound signal so that it is impossible to arrange a speaker and a microphone in close proximity in order to prevent howling. This prevents setting to obtain the depth and profundity of a musical sound similar to a natural musical instrument.

SUMMARY OF THE INVENTION

The invention has been proposed in view of the aforementioned problems and aims at providing an electronic musical instrument having an acoustic feedback system of a new configuration which allows setting to obtain the depth and profundity of a musical sound.

The invention comprises a main speaker for regenerating a performance sound by a performer, a microphone for picking up a sound regenerated from the main speaker, reflected sound generator for generating a reflected sound signal of a picked-up sound signal of the microphone, and an auxiliary speaker for regenerating a reflected sound signal generated on the reflected sound generator, wherein the microphone is arranged in a position relatively close to the main speaker and distant from the auxiliary speaker and wherein the main speaker, the auxiliary speaker and the microphone are arranged so that the sound regenerated from the auxiliary speaker may be acoustically fed back. With this configuration, when the performer gives a performance, the performance sound is regenerated from the main speaker, the regenerated sound is picked up by the microphone relatively close to the main speaker, a reflected sound signal is generated based on the microphone-picked-up signal, and the regenerated sound is regenerated from the auxiliary speaker relatively distant from the microphone. With this configuration, the microphone is arranged in a position relatively close to the main speaker and relatively distant from the auxiliary speaker, so that the ratio of the energy of the regenerated sound or performance sound of the main speaker is large in the microphone-picked-up signal. By generating a reflected sound signal from the microphone-picked-up sound signal and regenerating the reflected sound on the auxiliary speaker, an acoustic impression that the musical instrument itself such as a musical instrument enclosure and sound reflecting board is sounding is given to the performer and the audience close to the performer, thereby providing the depth and profundity of a musical sound similar to those of a natural musical instrument. The amount of acoustic feedback from the auxiliary speaker to a microphone can be used to adjust the effect of the depth and profundity of a musical sound. The microphone and the main speaker do not comprise an acoustic feedback system so that howling control is made easy between a microphone and a speaker thus providing a full effect of sounding of the musical instrument itself. Further, the loop gain of an acoustic feedback system comprising a microphone and an auxiliary speaker may be relatively small so that howling takes place less frequently. The performance sound regeneration system and the regeneration system for representing the sounding of a musical instrument are independent of each other so that appropriate signal processing may be made separately on these systems.

According to the invention, it is possible to arrange the main speaker in the direction where the speaker faces the performer and the auxiliary speaker in the direction where the speaker does not face the performer.

With this arrangement, the performance sound is audible clearly and favorable depth and profundity of a musical sound is obtained. In case the electronic musical instrument of the invention is a keyboard instrument such as an electronic piano, the main speaker is arranged for example in front of the musical instrument enclosure and the sounding surface is arranged toward the performer, and the auxiliary speaker is arranged at the rear of the musical instrument enclosure with its sounding surface oriented opposite to the performer, or on the upper surface of the musical instrument enclosure with its sounding surface oriented upward. In this case, the microphone may be arranged in a position adjacent to the main speaker in front of the musical instrument enclosure.

According to the invention, the microphone may be arranged within a distance double the diameter of at least one speaker unit of one or more speaker units comprising the main speaker from the center of the at least one speaker unit. By arranging the microphone in this way, surrounding environmental sounds such as sounds of shoes and pedals enter the microphone less frequently thus improving the S/N ratio of a sound regenerated from the auxiliary speaker.

According to the invention, in case the main speaker is a multi-way speaker, the microphone may be arranged in a position between a plurality of speaker units comprising the multi-way speaker. By arranging the microphone in this way, surrounding environmental sounds such as sounds of shoes and pedals enter the microphone less frequently thus improving the S/N ratio of a sound regenerated from the auxiliary speaker, as well as picking up the sound regenerated from each speaker unit relatively uniformly.

According to the invention, it is possible to set a relatively short initial delay time of the reflected sound signal generated on the reflected sound generator, for example 5 to 30 msec so as to represent the sounding of the musical instrument enclosure and obtain the favorable depth and profundity of a musical sound similar to those of a natural musical instrument. In this case, by setting a relatively short duration of the reflected sound signal, for example 300 to 600 msec, sounding of a musical instrument enclosure of a natural musical instrument is represented more clearly thus obtaining the favorable depth and profundity of a musical sound similar to those of a natural musical instrument.

According to the invention, in case a relatively long initial delay time of a reflected sound signal is set, the echo of a sound field or expanse of a sound field is perceptible rather than the sounding of a musical instrument itself or depth and profundity of a musical sound. In case a relatively long duration of a reflected sound signal, the echo of a sound field is perceived. Thus, by setting a relatively long initial delay time or duration of a reflected sound signal, for example setting the initial delay time to 30 to 60 msec and duration to 600 to 3000 msec, it is possible to represent the echo of a sound field.

According to the invention, it is possible to set the loop gain of an acoustic feedback system comprising the microphone and the auxiliary speaker to for example −6 dB or below. A loop gain of this level obtains the depth and profundity of a musical sound similar to those of a natural musical instrument and also prevents howling. The loop gain of an acoustic feedback system may be switched over depending on the number of regeneration systems. For example, the loop gain may be set to −6 dB or below for a single system (monaural), −9 dB or below for a two systems (2-channel stereo), and −12 dB or below for four systems (4-channel stereo).

The invention may further comprise automatic adjustment unit for regenerating a test sound from the auxiliary speaker to measure the loop gain of the acoustic feedback system and automatically adjusting the frequency response and sound volume of the circuit of the regeneration system of the auxiliary speaker so as to obtain the loop gain of a predetermined value of −6 dB or below. In this case also, it is possible to switch over the target value of the loop gain of an acoustic feedback system depending on the number of systems. For example, the loop gain may be set to a predetermined value of −6 dB or below for a single system (monaural), a predetermined value of −9 dB or below for a two systems (2-channel stereo), and a predetermined value of −12 dB or below for four systems (4-channel stereo).

According to the invention, the reflected sound generator may selectively generate a reflected sound signal whose initial delay time is 5 to 30 msec and whose duration is 300 to 600 msec or a reflected sound signal whose initial delay time is 30 to 60 msec and whose duration is 600 to 3000 msec, depending on the selection by a performer. With this configuration, in case the reflected sound signal whose initial delay time is 5 to 30 msec and whose duration is 300 to 600 msec is selected, the depth and profundity of a musical sound similar to those of a natural musical instrument is obtained, while in case the reflected sound signal whose initial delay time is 30 to 60 msec and whose duration is 600 to 3000 msec is selected, the expanse of a sound field is obtained.

In The present disclosure relates to the subject matter contained in Japanese patent application No. 2002-003011 (filed on Jan. 10, 2002), which is expressly incorporated herein by reference in their entireties.

DETAILED DESCRIPTION OF PREFERRED EMBODIMENTS

Figure 2A:
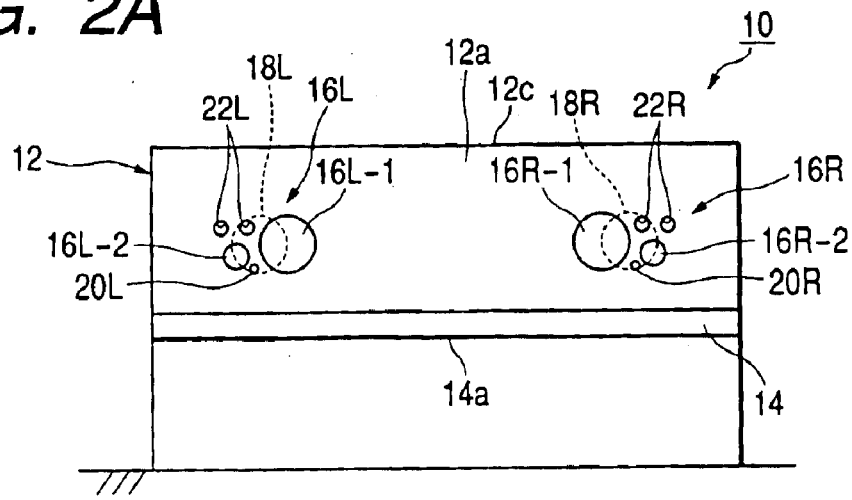
FIG. 2 shows an example of arrangement of a speaker and a microphone on the electronic musical instrument according to the invention.
Figure 2B:
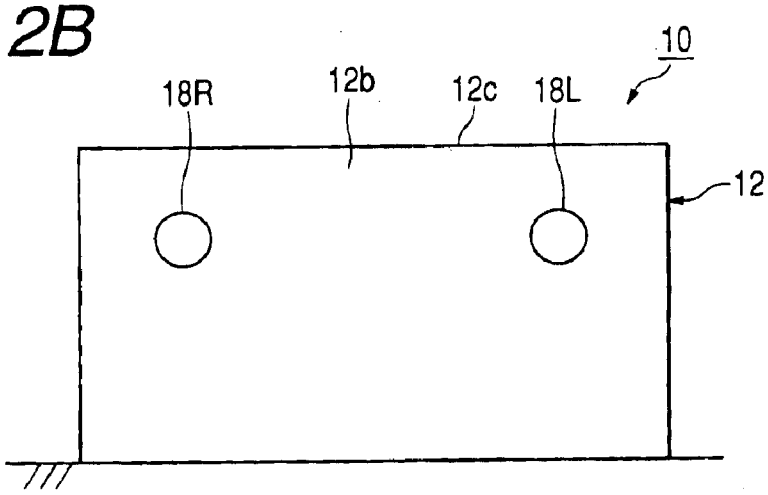
Figure 2C:
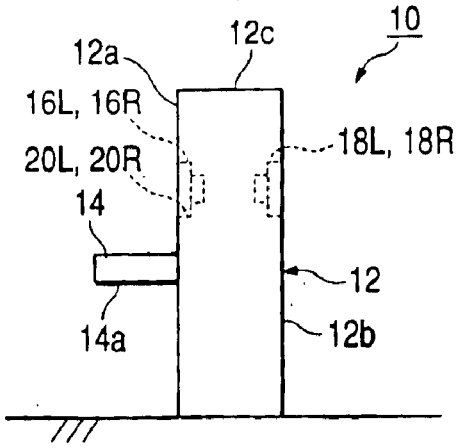

Embodiments according to the invention will be described. The following example is a case where the invention is applied to a two-system (2-channel stereo) electronic piano. FIG. 2 shows an example of arrangement of a speaker and a microphone on the electronic piano. The electronic piano 10 has an appearance which mimics an upright piano and comprises an enclosure 12 and a keyboard 14. In the enclosure 12 are housed a main speaker 16L, an auxiliary speaker 18L and a microphone 20L for a left channel, and a main speaker 16R, an auxiliary speaker 18R and a microphone 20R for a right channel with the sounding surface or the sound pick-up surface exposed to the outside. The main speakers 16L, 16R are arranged on the right and left of a position above the keyboard 14 on the front surface 12*a* of the enclosure 12, with its sounding surface exposed to the performer. The auxiliary speakers 18L, 18R are arranged on the right and left of a position above the keyboard 14 on the rear surface 12*b* of the enclosure 12, with its sounding surface exposed in the opposite direction to the performer. The microphones 20L, 20R are arranged on the right and left of a position above the keyboard 14 on the front surface 12*a* of the enclosure 12, relatively close to the main speakers 16L, 16R and distant from the auxiliary speakers 18L, 18R, with its sound pick-up surface exposed to the performer.

Figure 4:
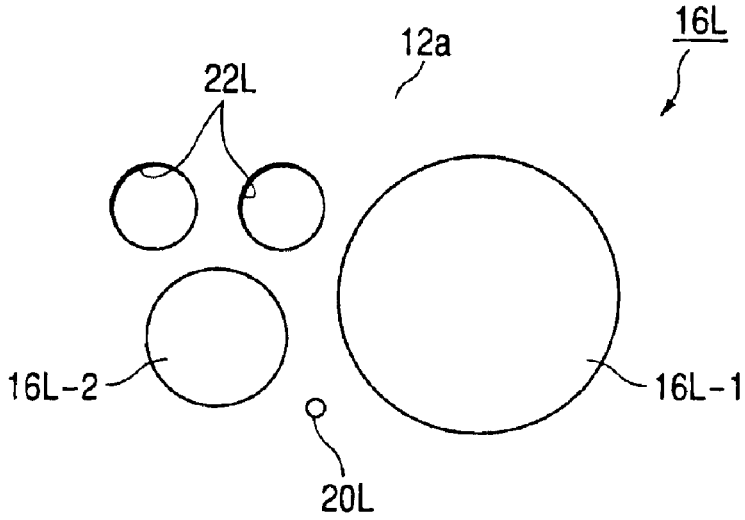
FIG. 4 is an expanded partial front view showing the arrangement of a speaker and a microphone on the left in front of the electronic musical instrument in FIG. 2.

FIG. 4 shows a detailed configuration of the left section of the front surface 12*a* of the enclosure 12. The main speaker 16L is composed as a 2-way speaker comprising a woofer 16L-1 and a tweeter 16L-2 as speaker units. A bass-reflex port 22L is formed at a position above the tweeter 16L-2 on the enclosure front surface 12*a*. The microphone 20L is arranged between the woofer 16L-1 and the tweeter 16L-2, in close proximity of the woofer 16L-1 and the tweeter 16L-2, for example with in a distance double the diameter of each speaker unit from the center of each unit. The right section of the front surface 12*a* of the enclosure 12 and the configuration in FIG. 4 form a symmetrical configuration. That is, as shown in FIG. 2, the main speaker 16R is composed as a 2-way speaker comprising a woofer 16R-1 and a tweeter 16R-2 as speaker units. In a position above the tweeter 16R-2 on the enclosure front surface 12*a* is formed a bass-reflex port 22R. The microphone 20R is arranged between the woofer 16R-1 and the tweeter 16R-2, in close proximity of the woofer 16R-1 and the tweeter 16R-2, for example within a distance double the diameter of each speaker unit from the center of each unit. The auxiliary speakers 18L, 18R may be constituted by, for example, one-way speakers respectively, as shown in FIG. 2B.

Figure 1:
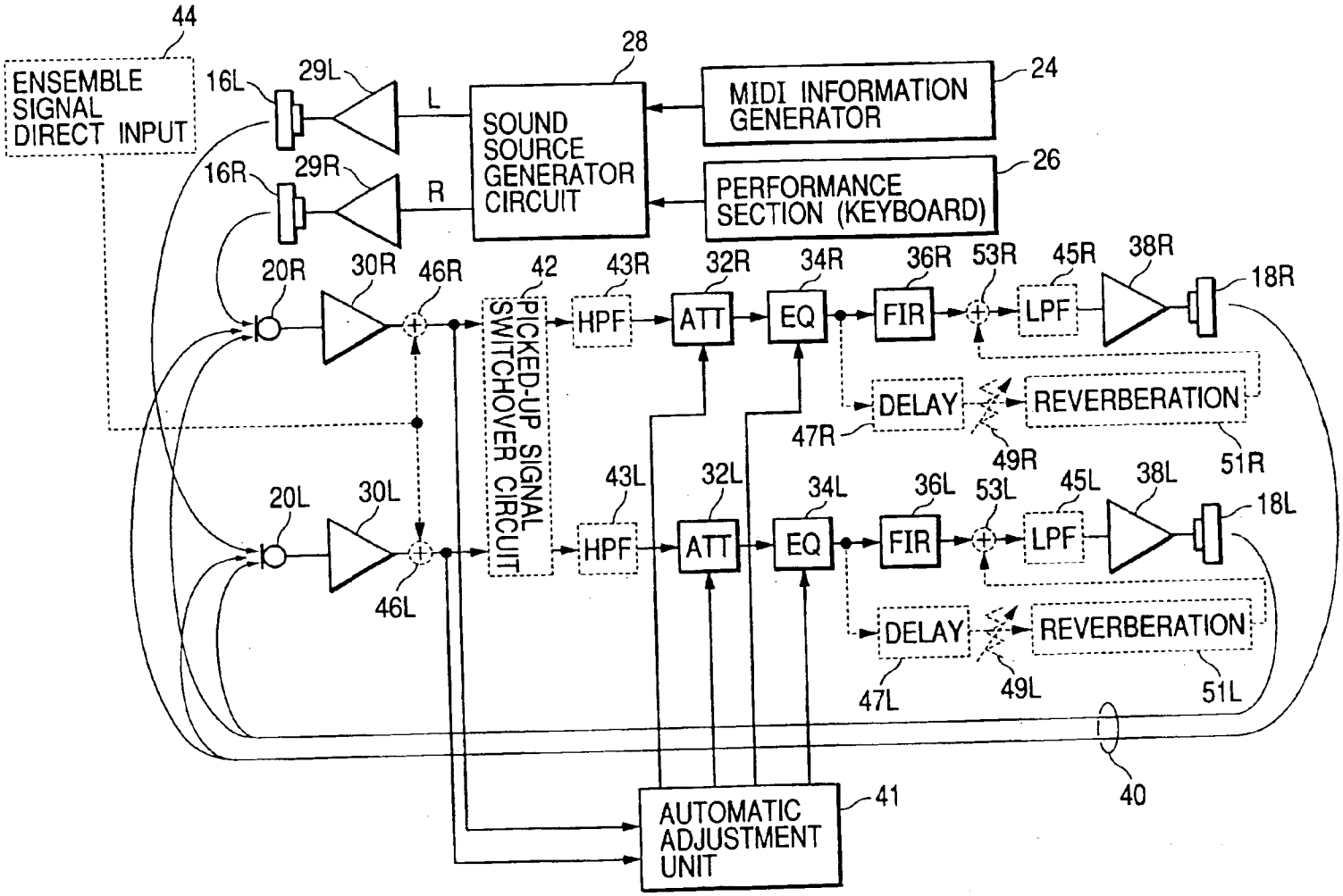
FIG. 1 shows the configuration of a circuit built into the electronic piano 10 in FIG. 2.
Figure 3:
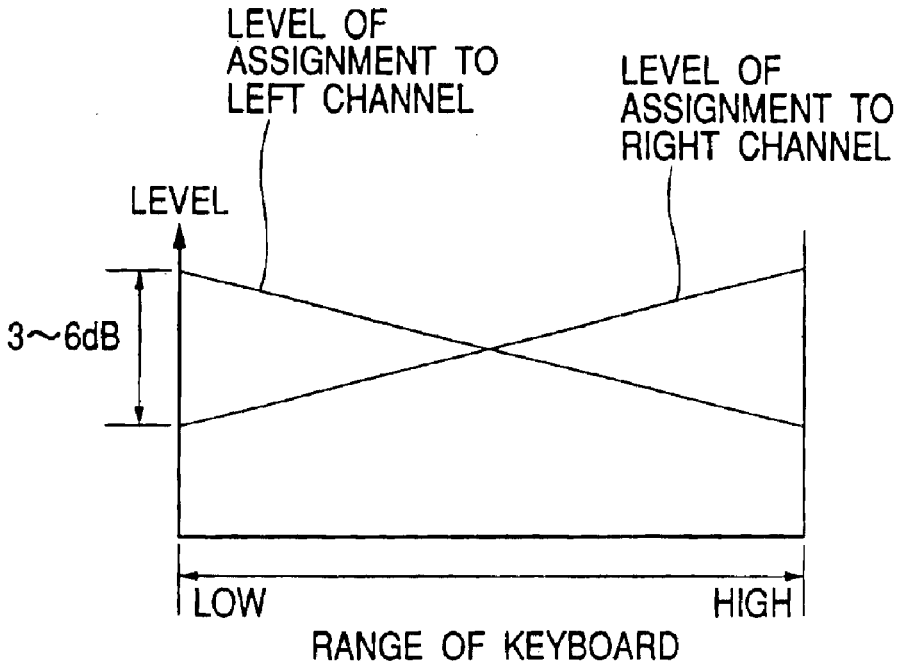
FIG. 3 is a diagram showing the level of assignment of a musical sound signal depending on the performance information generated from the sound source generation circuit 28 in FIG. 1 to right/left channels depending on the pitch of a sound.

FIG. 1 shows the configuration of a circuit built into the electronic piano 10 in FIG. 2. Accompaniment information stored in advance in the format of MIDI information is sequentially read from a MIDI information generator 24. Performance information according to the performance (keyboard operation) by the performer is output from a performance section 26. A sound source generator circuit 28 generates a left/right 2-channel musical sound signal according to the accompaniment information and performance information. More left/right 2-channel musical sound signals according to the performance information are assigned to the right channel as the sound pitch becomes higher and assigned to the left channel as the sound pitch becomes lower, as shown in FIG. 3. This mimics the orientation of a piano sound, a phenomenon that a higher range is more often heard from the right channel and a lower range from the left channel.

A musical sound signal generated by the sound source generator circuit 28 is regenerated from the left and right main speakers 16L, 16R respectively to the performer via power amplifiers 29L and 29R. The regenerated musical sound is picked up by the microphones 20L, 20R respectively. These picked-up musical sound signals are regenerated respectively from the auxiliary speakers 18L, 18R in the direction opposite to the performed via head amplifiers 30L, 30R, attenuators 32L, 32R, equalizers 34L, 34R, FIR (non-cyclic) filters (Finite Impulse Response Filter) 36L, 36R, and power amplifiers 38L, 38R. The musical sound regenerated from the auxiliary speakers 18L, 18R reflects on the wall or ceiling of the room and is acoustically fed back to microphones 20L, 20R.

With this configuration, a performance sound and an accompaniment sound are regenerated in the direction from the main speakers 16L, 16R to the performer, and the regenerated sound is picked up by the microphones 20L, 20R. Reflected sound based on the picked-up sound signal is generated by the FIR filters 36L, 36R and regenerated in the direction opposite to the performer from the auxiliary speakers 18L, 18R. The sound regenerated from the auxiliary speakers 18L, 18R is used to represent the sounding of the musical instrument enclosure, or a musical instrument enclosure and sound reflecting board in a grand piano. The attenuators 32L, 32R adjust the gain or sound volume of an acoustic feedback system 40 and are adjusted automatically or manually by way of manual operation of the performer. By adjusting the gain of the acoustic feedback system 40, it is possible to adjust the degree of sounding of the musical instrument enclosure of a natural musical instrument. The gain of the acoustic feedback system 40 required to represent the musical instrument enclosure of a natural musical instrument may be a relatively small value. Adjustment range of the gain of the acoustic feedback system 40 by using the attenuators 32L, 32R is for example −6 dB to −18 dB. In case the gain of the acoustic feedback system 40 is −6 dB or below, howling takes place less frequently. The equalizers 34L, 34R smoothes the frequency response of the acoustic feedback system 40 and are automatically adjusted. This further suppresses howling. The FIR filters 36L, 36R generate the reflected sound of a microphone-picked-up sound.

Automatic adjustment of the attenuators 32L, 32R and equalizers 34L, 34R is made based on an adjustment instruction of the performer for example before performance. When the performer gives an automatic adjustment instruction, a test sound, for example a pink noise is regenerated from the main speakers 16L, 16R. The regenerated sound is picked up by the microphones 20L, 20R, regenerated from the auxiliary speakers 18L, 18R, and fed back to the microphones 20L, 20R via the acoustic feedback system 40. In this practice, an automatic adjustment unit 41 measures the loop gain and the frequency response of the acoustic feedback system 40, automatically adjusts the equalizers 34L, 34R so as to smooth the frequency response of the acoustic feedback system 40, and automatically adjusts the gain of the attenuators 32L, 32R so that the loop gain of the acoustic feedback system 40 may reach for example −12 dB. In this example, in case the number of systems is 2 and the loop gain is around −12 dB, howling can be prevented. The characteristics of the equalizers 34L, 34R are fixed to the automatically adjusted characteristics until another automatic adjustment is instructed. The gain of the attenuators 32L, 32R may be manually adjusted by the performer within a range of ±6 dB for example (within the range of −6 dB to −18 dB as the loop gain of the acoustic feedback system 40).

Figure 5:
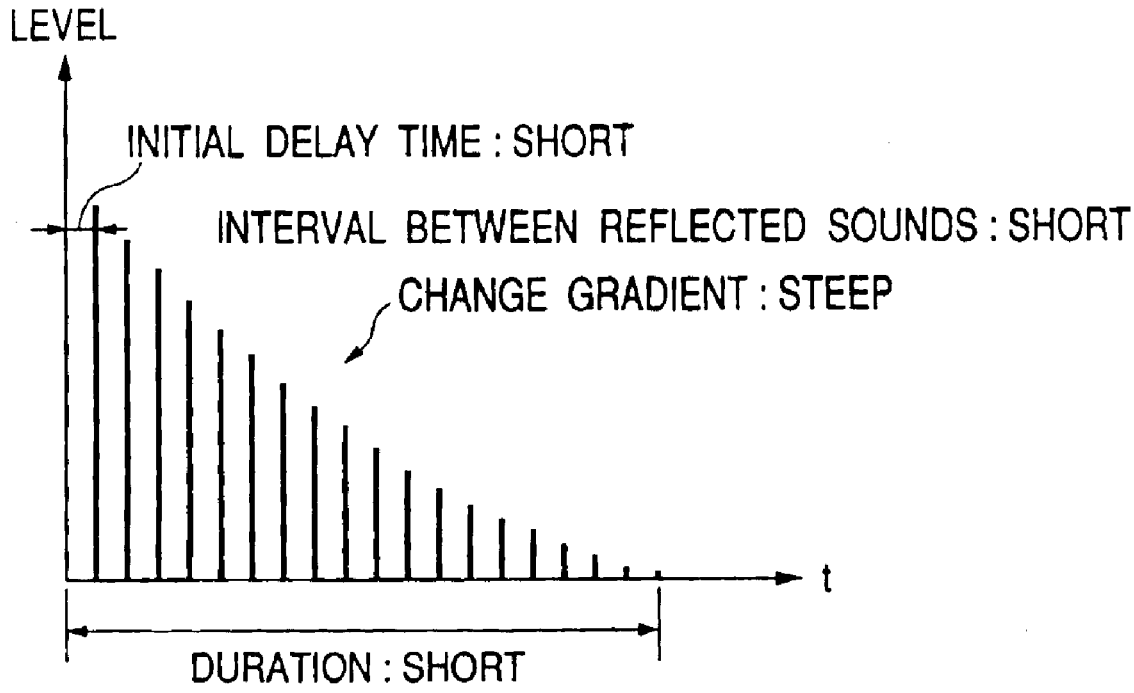
FIG. 5 shows the outline of the reflected sound characteristics (impulse response) set to the FIR filters 36L, 36R.

FIG. 5 shows the outline of the reflected sound characteristics (impulse response) set to the FIR filters 36L, 36R. The reflected sound characteristics to represent the sounding of a musical instrument enclosure of a natural musical instrument have a relatively short initial delay time (for example 5 to 30 msec) and a relatively short duration (for example 300 to 600 msec), a relatively steep gradient of change in attenuation and a relatively short interval between reflected sounds.

Figure 7:
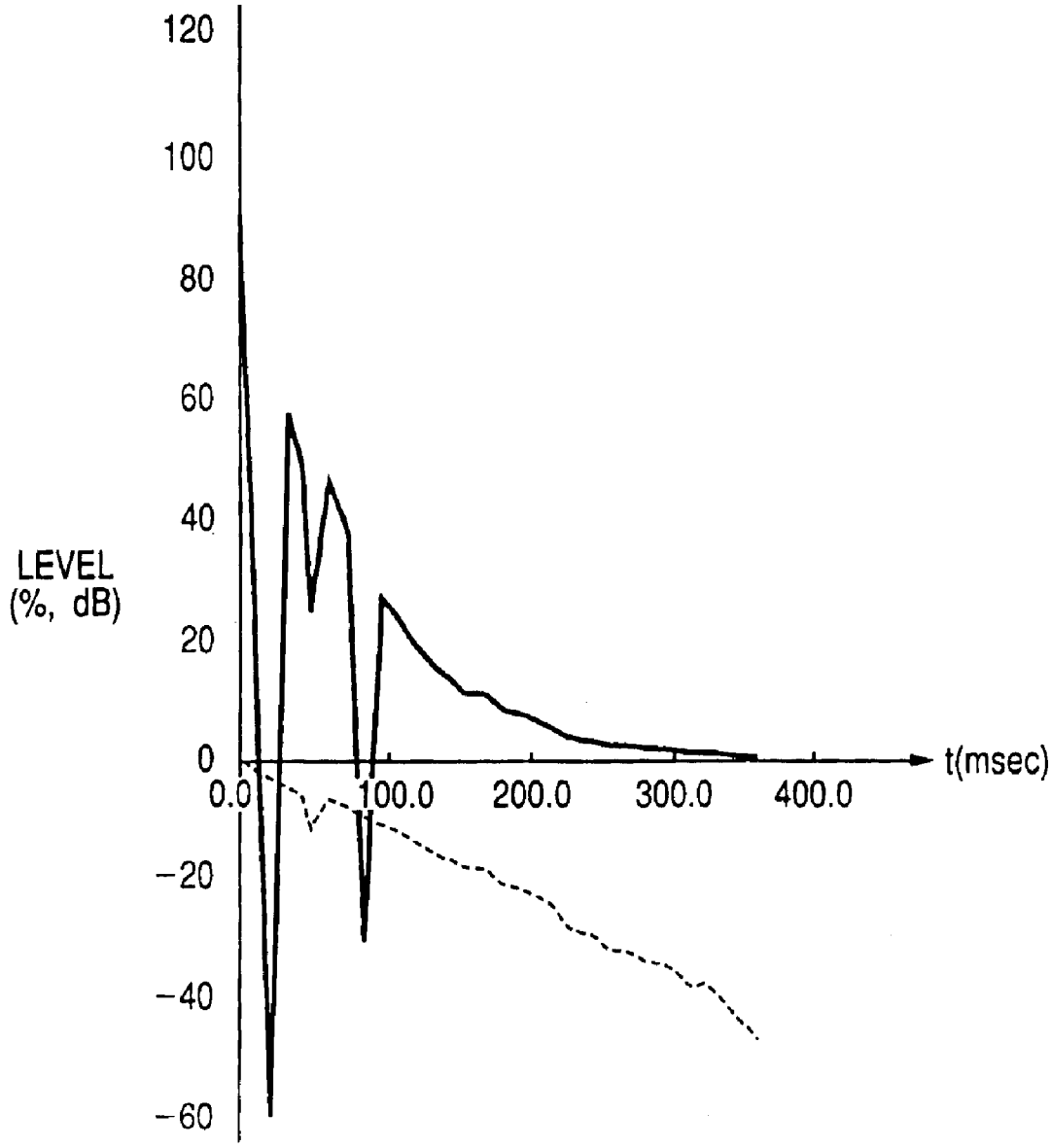
FIG. 7 shows an example of the envelope of reflected sound parameters set to the FIR filter 36R-1.
Figure 8:
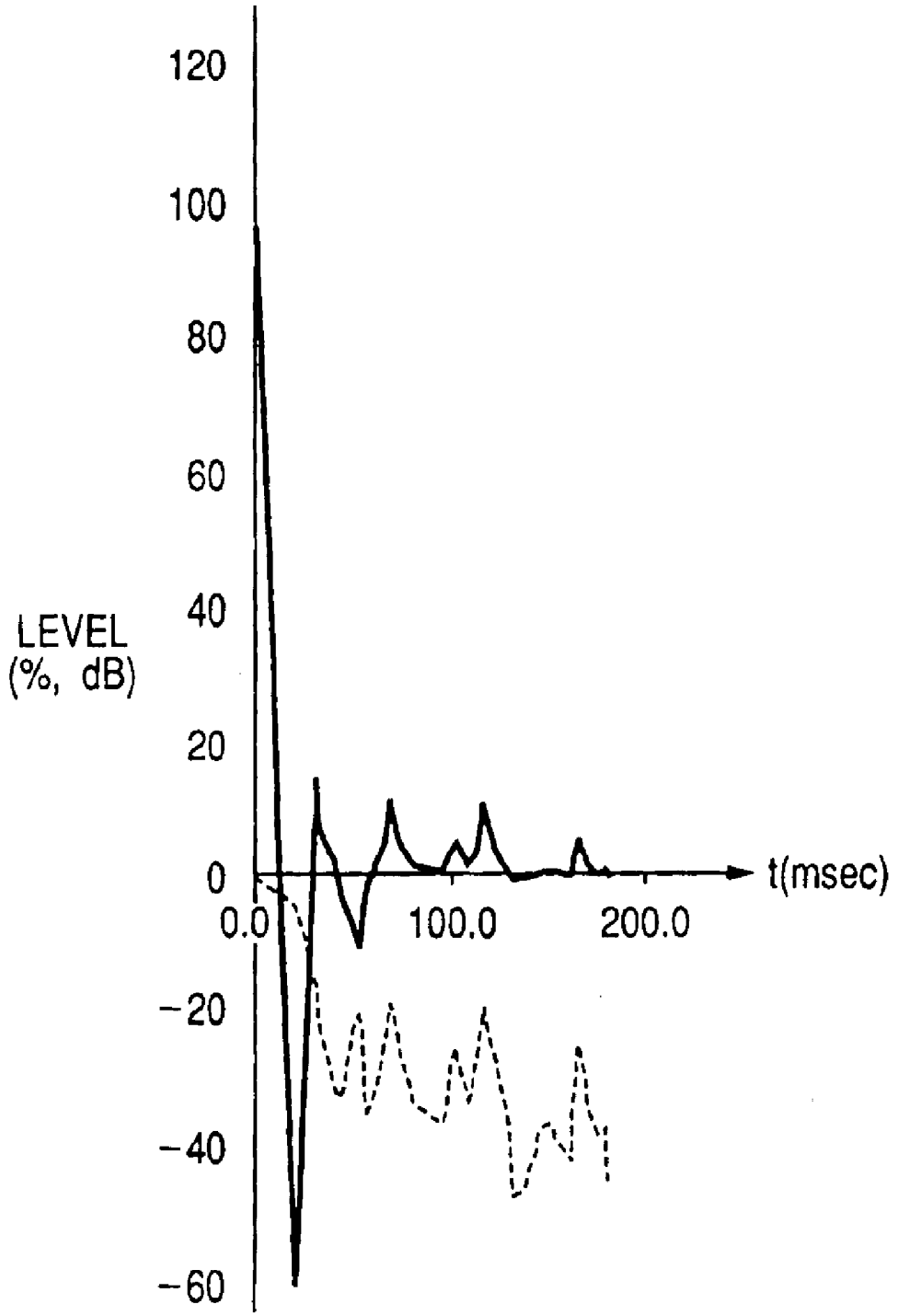
FIG. 8 shows an example of the envelope of reflected sound parameters set to the FIR filter 36R-2.
Figure 10:
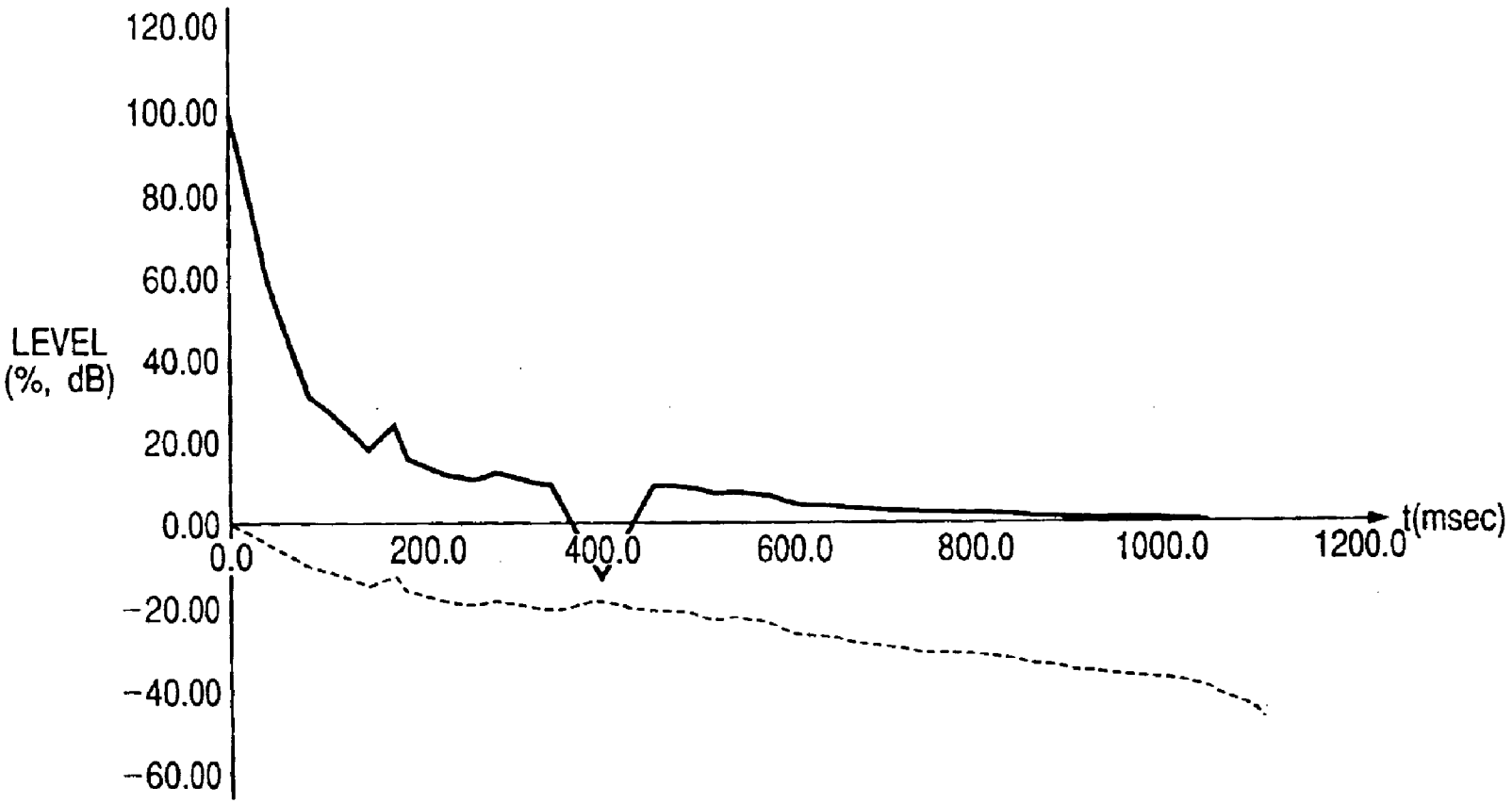
FIG. 10 shows an example of the envelope of reflected sound parameters set to the FIR filter 36L-1.
Figure 11:
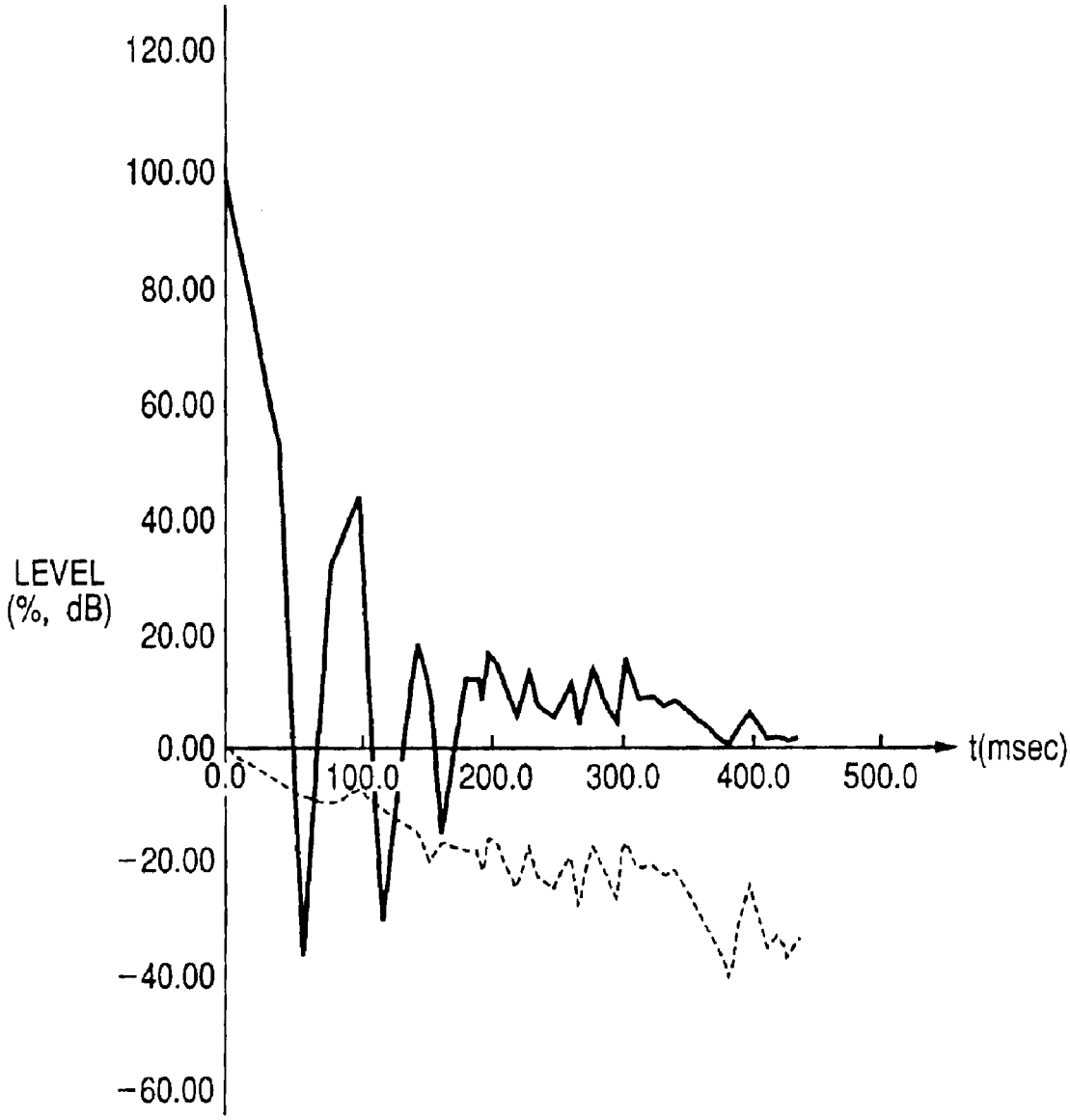
FIG. 11 shows an example of the envelope of reflected sound parameters set to the FIR filter 36L-2.

A specific example of the FIR filters 36L, 36R will be described. The FIR filters 36L (36R) may be constituted by two FIR filters 36L-1, 36L-2 (36R-1, 36R-2) of a dual-stage configuration. The FIR filter 36L-1 (36R-1) in the first stage is a filter for determining the attenuation process of a reflected sound. The FIR filter 36L-2 (36R-2) in the second stage is a filter for determining the timbre of a reflected sound. FIG. 7 shows an example of the envelope of reflected sound parameters set to the FIR filter 36R-1. In FIG. 7, a solid line indicates the level (%) of a reflected sound (100%=0 dB), a dotted line the absolute value (dB) of the reflected sound (assuming the level of the reflected sound as L, a value corresponding to $20_{log10}$ (|L|/100)). Meaning of the representation in FIGS. 8, 10 and 11 is the same as this. The initial delay time of the reflected sound parameter is 5.84 msec or below, the duration is 400 msec or below. The reflected sound parameters set to the FIR filter 36L-1 are similar to those set to the FIR filter 36R-1. The initial delay time is a value obtained by adding 6 to 8 msec to the initial delay time of the FIR filter 36R-1, that is, 11.84 to 13.84 msec and the duration 400 msec or below. By setting the initial delay time of the FIR filter 36L-1 longer than that of the FIR filter 36R-1 by 6 to 8 msec, a musical sound containing a large amount of high range picked up by the microphone 20R is provided first, then a musical sound containing a large amount of low range picked up by the microphone 20L is provided 6 to 8 msec later. This represents the sounding of a musical enclosure such as a grand piano more naturally in terms of sense of hearing.

FIG. 8 shows an example of the envelope of reflected sound parameters set to the FIR filter 36R-2. The reflected sound parameter set to the FIR filter 36R-2, namely, the initial delay time is 0 msec and the duration is about half that of the reflected sound parameters set to the FIR filter 36R-1.

The reflected sound parameters set to the FIR filter 36L-2 are similar to those set to the FIR filter 36R-2. The initial delay time is 0 msec and the duration is about half that of the reflected sound parameters set to the FIR filter 36L-1.

Figure 9:
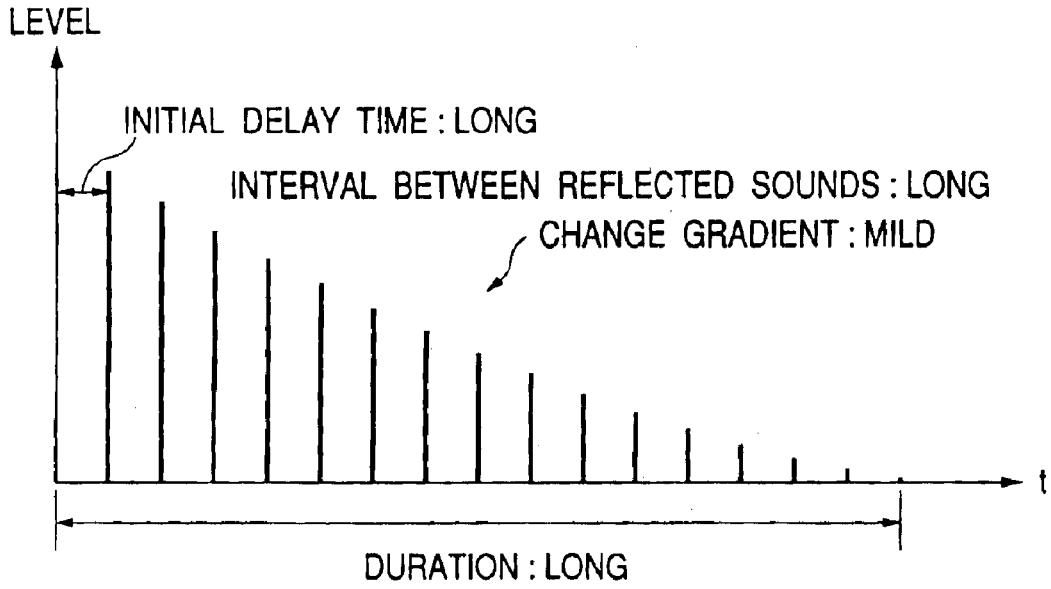
FIG. 9 shows the outline of the reflected sound characteristics (impulse response) set to the FIR filters 36L, 36R in a mode where the echo of a sound field is represented.

BY switching over the impulse response set to the FIR filters 36L, 36R, it is possible to represent the echo of a sound field instead of representing the sounding of a musical instrument enclosure of a natural musical instrument. FIG. 9 shows the outline of the reflected sound characteristics (impulse response) set to the FIR filters 36L, 36R for representing the echo of a sound field. The reflected sound characteristics to represent the echo of a sound field have a longer initial delay time, for example 30 to 60 msec, longer duration (for example 600 to 3000 msec), a milder gradient of change in attenuation and a longer interval between reflected sounds in comparison with the reflected sound characteristics to represent the sounding of a musical instrument enclosure of a natural musical instrument (FIG. 5).

Figure 6:
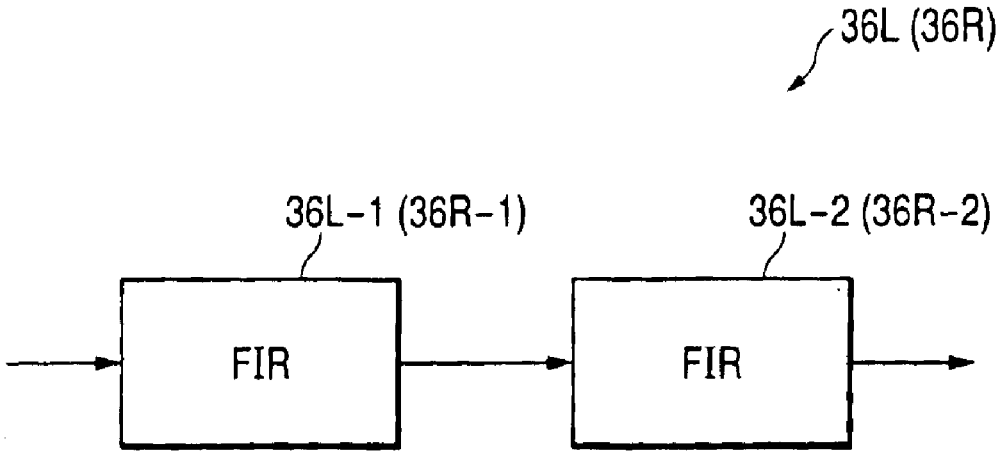
FIG. 6 is a block diagram showing a configuration example of the FIR filters 36L, 36R in FIG. 1.

Reflected sound parameters set to the FIR filters 36L1, 36L-2 (36R-1, 36R-2) in FIG. 6 for representing the echo of a sound field will be described. FIG. 10 shows an example of the envelope of reflected sound parameters set to the FIR filter 36L-1. The initial delay time of the reflected sound parameters is 31.5 msec and the duration is about 1000 msec. The reflected sound parameters set to the FIR filter 36R-1 are similar to those set to the FIR filter 36L-1. The initial delay time is 31.5 msec and the duration is about 1000 msec. FIG. 11 shows an example of the envelope of reflected sound parameters set to the FIR filter 36L-2. The initial delay time of the reflected sound parameters set to the FIR filter 36L-2 is 0 msec and the duration is about half that of the reflected sound parameters set to the FIR filter 36L-1. The reflected sound parameters set to the FIR filter 36R-2 are similar to those set to the FIR filter 36L-2. The initial delay time is 0 msec and the duration is about half that of the reflected sound parameters set to the FIR filter 36R-1.

In case the function of switch over the reflected sound parameters is incorporated, each reflected sound parameter is stored in memory and corresponding reflected sound parameter is read from memory based on the selection by the performer and set to the FIR filter. In the mode where the echo of a sound field is represented, attenuators 32L, 32R are constructed so that the gain thereof can be set greater than that in the mode where the sounding of a musical instrument enclosure of a natural musical instrument is represented.

In the circuit of FIG. 1, it is possible to add a configuration shown by dotted lines. Each configuration shown by dotted lines will be described.

(a) In the mode where the echo of a sound field is represented, a signal switchover circuit 42 is arranged between the head amplifiers 30L, 30R and the attenuators 32L, 32R. The signal path (connection of the head amplifiers 30L, 30R and the attenuators 32L, 32R) is gently switched over with the output level maintained over a relatively long cycle (for example a cycle equal to the reverberation time of the room used to half that time).

(b) An ensemble signal direct input 44 from another electronic musical instrument or microphone is added to and mixed with the output of the head amplifiers 30L, 30R by using adders 46L, 46R (applicable to both modes).

(c) For each signaling system, high-pass filters 43L, 43R are arranged in appropriate locations (for example between the picked-up signal switchover circuit 42 and the attenuators 32L, 32R) to eliminate a dark noise, for example a sound at 63 Hz or below, contained in the microphone-picked-up signal (applicable to both modes).

(d) For each signaling system, low-pass filters 45L, 45R are arranged after the FIR filters 36L, 36R. The characteristics of the low-pass filters 45L, 45R are switched over in linkage to the switchover of modes. In the mode where the sounding of a musical instrument enclosure of a natural musical instrument is represented, the frequency response of the sounding of the musical instrument enclosure owned by the natural musical instrument is represented by adjusting the attenuation between for example 8 kHz and 10 kHz. In the mode where the echo of a sound field is represented, attenuation in the high range (attenuation in the high range is faster than that in the middle range due to air absorption) of a reverberation sound in a sound field such as a concert hall is represented.

(e) A signal before being input to the FIR filter 36L is delayed by a predetermined time in a delay circuit 47L, level-adjusted by an attenuator 49L, a reverberation signal is generated in a reverberation circuit 51L, and the signal is added to the output signal of the FIR filter 36L by way of an adder 53L. Similarly, a signal before being input to the FIR filter 36R is delayed by a predetermined time in a delay circuit 47R, level-adjusted by an attenuator 49R, a reverberation signal is generated in a reverberation circuit 51R, and the signal is added to the output signal of the FIR filter 36R by way of an adder 53R. The delay time of the delay circuits 47L, 47R is set to for example 50 msec or more. The reverberation circuits 51L, 51R are IIR (cyclic) filters. In this way, in the mode where the echo of a sound field is represented, it is possible to represent a later reflected sound by increasing the number of reflected sounds without using large-scale citrus as the FIR filters 36L, 36R. In the mode where the sounding of a musical instrument enclosure of a natural musical instrument is represented, this configuration is used to minutely represent the sounding of a musical instrument enclosure.

Figure 12A:
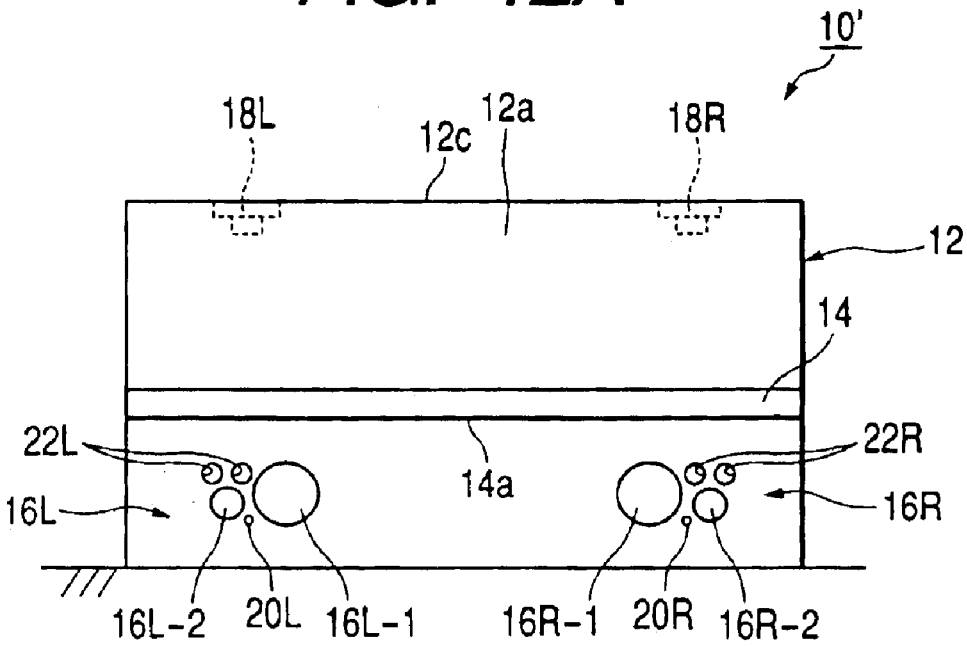
FIGS. 12A and 12B show another example of arrangement of a speaker and a microphone on an electronic musical instrument according to the invention.
Figure 12B:
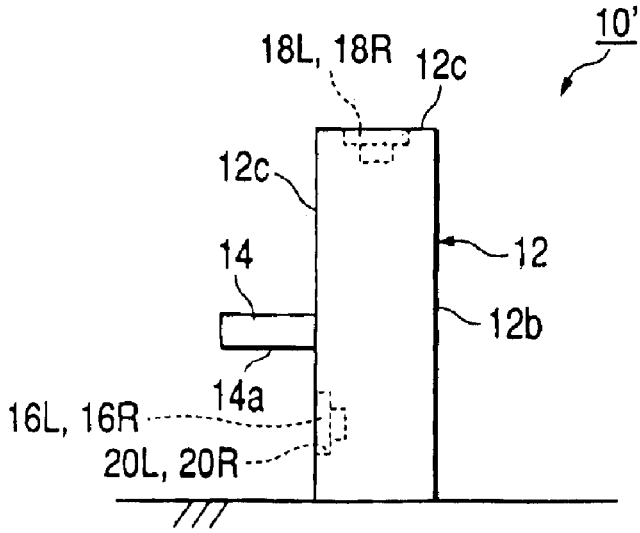

FIGS. 12A and 12B show another example of arrangement of a speaker and a microphone on an electronic piano according to the invention. The same numerals are used for sections common to those in FIG. 2. An electronic piano 10' has an appearance which mimics an upright piano and comprises an enclosure 12 and a keyboard 14. In the enclosure 12 are housed a main speaker 16L, an auxiliary speaker 18L and a microphone 20L for a left channel and a main speaker 16R, an auxiliary speaker 18R and a microphone 20R for a right channel with the sounding surface or the sound pick-up surface exposed to the outside. The main speakers 16L, 16R are arranged on the right and left of a position below the keyboard 14 on the front surface 12*a* of the enclosure 12, with its sounding surface exposed to the performer. The auxiliary speakers 18L, 18R are arranged on the right and left of the upper surface of the enclosure 12, with its sounding surface oriented upward. The microphones 20L, 20R are arranged on the right and left of a position below the keyboard 14 on the front surface 12*a* of the enclosure 12, relatively close to the main speakers 16L, 16R and distant from the auxiliary speakers 18L, 18R, with its sound pick-up surface exposed to the performer. Configuration of the main speaker 16L and the microphone 20L on the left and their mutual relation are as shown in FIG. 4. Configuration of the main speaker 16R and the microphone 20R on the right and their mutual relation and those in FIG. 4 form a symmetrical configuration.

The main speakers 16L, 16R and the microphones 20L, 20R may be arranged on the right and left of a position above the keyboard 14 on the front surface 12*a* of the enclosure 12 as shown in FIG. 2. The auxiliary speakers 18L, 18R maybe arranged on the right and left of the upper surface 12*c* of the enclosure 12, with its sounding surface oriented upward. Or conversely, the main speakers 16L, 16R and the microphones 20L, 20R may be arranged on the right and left of a position below the keyboard 14 on the front surface 12*a* of the enclosure 12 as shown in FIG. 4. The auxiliary speakers 18L, 18R may be arranged on the right and left of the rear surface of the enclosure 12, with its sounding surface oriented opposite to the performer, as shown in FIG. 2.

While speakers and microphones are housed in the enclosure 12 of the electronic piano 10 in the embodiment described, it is possible to fix or movably mount the speakers and microphones on the external surface of the enclosure 12, for example mount the speakers and microphones on the upper surface 12*c* of the enclosure 12 or suspended from the bottom surface 12*a* of the keyboard 12. While the number of systems is 2 in the foregoing embodiment, the invention may be applied to an electronic musical instrument comprising a single regeneration system or three or more regeneration systems. While the invention is applied to an electronic piano, it is applicable to other types of electronic keyboard instruments or electronic musical instruments other than electronic keyboard instruments.

What is claimed is:

1. An electronic musical instrument comprising:

a main speaker which regenerates a performance sound by a performer;

a microphone which picks up a sound regenerated by the main speaker, a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein only the auxiliary speaker regenerates the reflected sound picked up by the microphone.

2. The electronic musical instrument according to claim 1, wherein the main speaker is arranged in the direction facing the performer and the auxiliary speaker is arranged in the direction not facing the performer.

3. The electronic musical instrument according to claim 2, wherein the main speaker is arranged in front of a musical instrument enclosure with a sounding surface thereof oriented to the performer, and the auxiliary speaker is arranged at a rear of the musical instrument enclosure with a sounding surface thereof oriented opposite to the performer.

4. The electronic musical instrument according to claim 3, wherein the microphone is arranged in a position adjacent to the main speaker.

5. The electronic musical instrument according to claim 2, wherein the main speaker is arranged in front of a musical instrument enclosure with a sounding surface thereof oriented to the performer, and the auxiliary speaker is arranged on an upper surface of the musical instrument enclosure with the sounding surface oriented upward.

6. The electronic musical instrument according to claim 5, wherein the microphone is arranged in a position adjacent to the main speaker.

7. The electronic musical instrument according to claim 1, wherein the main speaker is constituted by at least one speaker unit, and the microphone is arranged within a distance double the diameter of at least one of the at least one speaker unit from the center thereof.

8. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein the main speaker is a multi-way speaker and the microphone is arranged in a position between a plurality of speaker units constituting the multi-way speaker.

9. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein initial delay time of the reflected sound signal generated by the reflected sound generator is 5 to 30 msec.

10. The electronic musical instrument according to claim 9, wherein duration of the reflected sound signal generated by the reflected sound generator is 300 to 600 msec.

11. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein initial delay time of the reflected sound signal generated by the reflected sound generator is 30 to 60 msec.

12. The electronic musical instrument according to claim 11, wherein duration of the reflected sound signal generated by the reflected sound generator is 600 to 3000 msec.

13. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein an acoustic feedback system constituted by the microphone and the auxiliary speaker has a loop gain of −6 dB or below.

14. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal;

an automatic adjustment unit which automatically adjusts frequency response and sound volume of a circuit of a regeneration system of the auxiliary speaker so as to obtain the loop gain having a predetermined value of −6 dB or below by regenerating a test sound from the auxiliary speaker, wherein the microphone is arranged in a position relatively close to the main speaker and distant from the auxiliary speaker, and wherein the main speaker, the auxiliary speaker, and the microphone are arranged so that the sound regenerated by the auxiliary speaker is acoustically fed back to the microphone.

15. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein the reflected sound generator selectively generates a reflected sound signal whose initial delay time is 5 to 30 msec and whose duration is 300 to 600 msec or a reflected sound signal whose initial delay time is 30 to 60 msec and whose duration is 600 to 3000 msec, depending on the selection by a performer.

16. The electronic musical instrument according to claim 1, wherein the reflected sound generator includes a FIR filter.

17. The electronic musical instrument according to claim 16, wherein the microphone and the auxiliary speaker are electrically connected each other through an attenuator, an equalizer and the FIR filter.

18. An electronic musical instrument comprising:

a main speaker which regenerates a performance sound by a performer;

a microphone which picks up a sound regenerated by the main speaker;

a reflected sound generator which generates a reflected sound signal from the sound picked up by the microphone; and an auxiliary speaker for regenerating the reflected sound from the reflected sound signal, wherein the microphone is arranged in a position relatively close to the main speaker and distant from the auxiliary speaker, wherein the main speaker, the auxiliary speaker, and the microphone are arranged so that the sound regenerated by the auxiliary speaker is acoustically fed back to the microphone, and wherein the main speaker is arranged in the direction facing the performer and the auxiliary speaker is arranged in the direction not facing the performer.

19. The electronic musical instrument according to claim 18, wherein the main speaker is arranged in front of a musical instrument enclosure with a sounding surface thereof oriented to the performer, and the auxiliary speaker is arranged on an upper surface of the musical instrument enclosure with the sounding surface oriented upward.

* * * * *